US005396473A

United States Patent [19]

Crettenand

[11] Patent Number: 5,396,473

[45] Date of Patent: Mar. 7, 1995

[54] TIMEPIECE INCLUDING A POWER CELL COMPARTMENT CLOSED BY A GASKET SEAL

[75] Inventor: Jacques Crettenand, Conthey, Switzerland

[73] Assignee: Eta Sa Fabriques d'Ebauches, Grenchen, Switzerland

[21] Appl. No.: 142,003

[22] Filed: Oct. 28, 1993

[30] Foreign Application Priority Data

Nov. 11, 1992 [CH] Switzerland ..... 03486/92

[51] Int. Cl.[6] ..... G04B 1/00

[52] U.S. Cl. ..... 368/204; 368/291

[58] Field of Search ..... 368/204, 309, 310, 291, 368/292

[56] References Cited

U.S. PATENT DOCUMENTS 4,488,345 12/1984 Müller et al. .

FOREIGN PATENT DOCUMENTS 999677 2/1952 France .

531202 11/1972 Switzerland .

2100891 1/1983 United Kingdom .

*Primary Examiner*—Bernard Roskoski

*Attorney, Agent, or Firm*—Pollock, Vande Sande & Priddy

[57] ABSTRACT

The invention concerns a timepiece of the type including: a case (2); a power cell compartment (4) formed by a housing (6) arranged in the interior of the case (2) so as to receive an electrical energy source formed by a power cell (P); and means for closing the housing (6), such means including a movable cap (14) capable of being mechanically latched onto the case (2) and a gasket seal (16) shaped to be interposed between the cap (14) and the case (2), such timepiece being characterized in that the gasket seal (16) is a seal with a full lip extending over the entire frontal surface (SF) of the power cell (P) and assuring, in addition to the sealing of the housing (6), an axial bearing of the power cell (P) towards the bottom of the housing (6).

7 Claims, 1 Drawing Sheet

TIMEPIECE INCLUDING A POWER CELL COMPARTMENT CLOSED BY A GASKET SEAL

The present invention concerns a timepiece including a power cell compartment closed by a gasket seal which can be installed in a reliable and easy manner and can resist very high pressure.

BACKGROUND OF THE INVENTION

Known timepieces include a power cell compartment generally closed by a cap which is latched onto the case by a bayonet mechanism and which is associated with a seal interposed between the cap and the case. Such seal, in the known type of arrangement, is constituted by a toroidal seal generally known under the designation of "O-ring" which does not give satisfaction for reasons of assembly.

Effectively, such type of seal during assembly has the tendency to be displaced relative to the cap and, being from then on incorrectly positioned relative to the case, does not in use assure the required sealing.

Thus, the present invention has as purpose to overcome this drawback by providing a timepiece in which the power cell compartment and the associated cap are provided with a gasket seal, the installation of which can be easily assured in a reliable and repetitive manner, while being capable of assuring perfect sealing under conditions of high pressure.

SUMMARY OF THE INVENTION

To this effect, the present invention has as objective a timepiece of the type comprising:

a watch case;

a power cell compartment formed by a housing arranged in the interior of said case so as to receive an electrical energy source formed by a power cell, and closing means for said housing, such means including a movable cap capable of being mechanically latched onto the case and a gasket seal shaped to be interposed between the cap and said case, characterized in that the gasket seal is a seal with a full lip extending over the entire frontal surface of the power cell and assuring, in addition to the sealing of the housing, an axial bearing of the power cell towards a bottom of the housing.

According to still another characteristic of the invention, said cap includes an intermediate stopper which is freely housed in such cap and which is in direct bearing on a peripheral lip of the gasket seal.

It will also be specified that the case according to the invention includes a tapered bearing surface opening out towards an entrance of said housing, the lip of the gasket seal which rests on such bearing surface being maintained confined by a second tapered bearing surface arranged on the periphery of the stopper.

It will be further specified that according to another embodiment the lip extends beyond the tapered bearing surfaces which maintain it and projects towards the exterior in the vicinity of the peripheral edge of the cap.

BRIEF DESCRIPTION OF THE DRAWING

Other characteristics and advantages of the invention will appear upon reading the detailed description which follows, made with reference to the single attached figure (FIG. 1) which represents, in cross-section, a timepiece according to the invention.

DESCRIPTION OF THE PREFERRED EMBODIMENT

Figure 1:
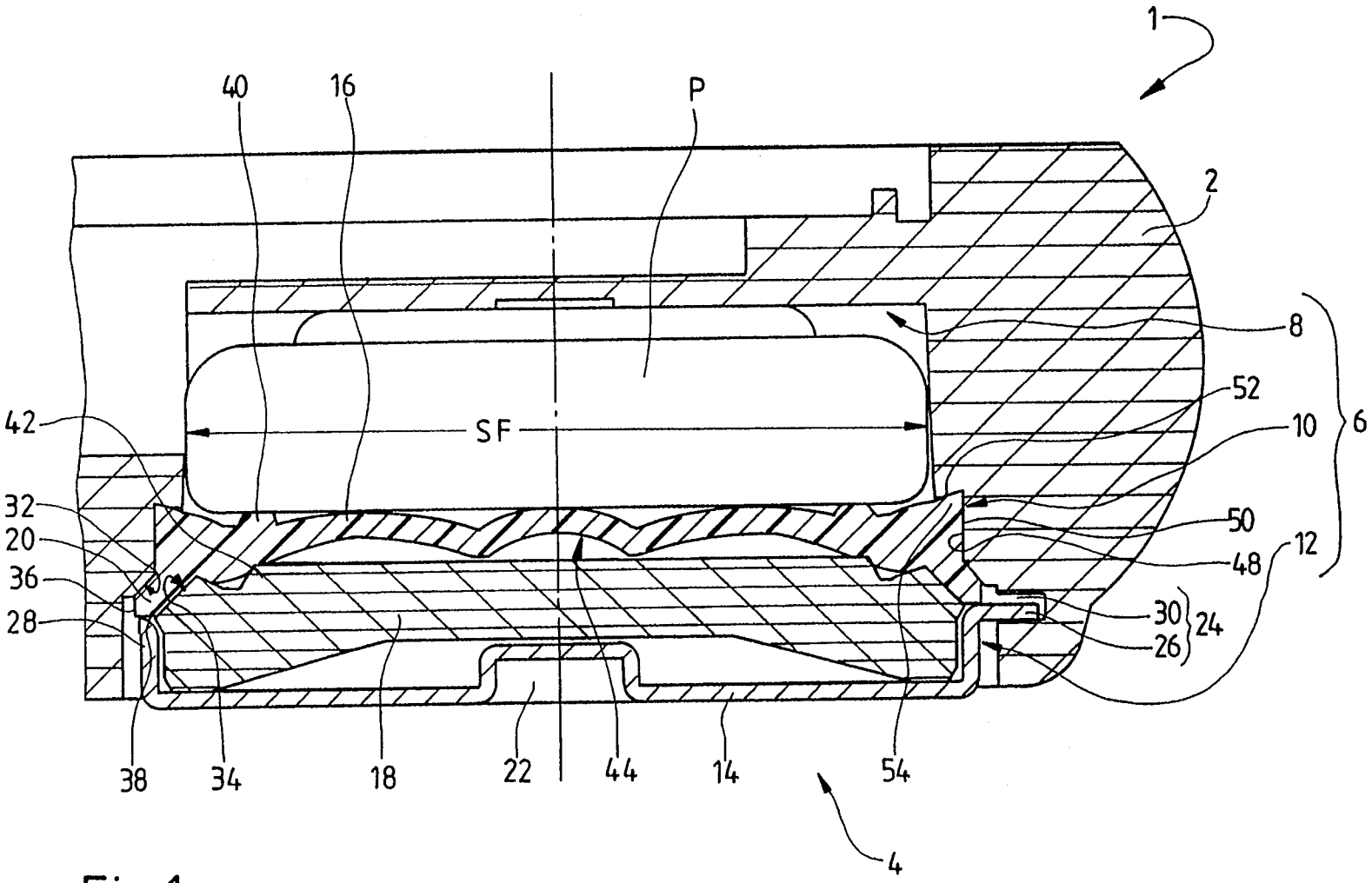

As seen in FIG. 1, the timepiece according to the invention which is here designated by the general reference 1, includes a case 2 formed of an organic material such as a thermoplastic material, for example, of acrylonitrile butadiene styrene referenced under the abbreviation ABS.

With such case 2, of which only those portions necessary for understanding of the invention have been shown, are generally associated a crystal, a dial as well as a movement and hands, not shown.

On the interior of case 2 is arranged a cell compartment 4 which is constituted by a stepped housing 6 formed on the interior of case 2 in order to receive an electrical energy source P, formed by a button cell of known type.

To this effect, electrical contact elements, also not shown, are generally arranged within the cell compartment 4 in order to assure electrical contact between the positive and negative terminals of the cell, and the electrical and electronic components of the timepiece according to the invention.

The stepped housing 6 of the cell compartment 4 includes three characteristic portions: a bottom portion 8 which receives cell P as well as the associated electrical contact elements, not shown, an intermediate portion 10 receiving more specifically a gasket seal which will be described hereinafter, and an entrance portion 12 receiving a cap 14 for closing the compartment 4.

Furthermore, the timepiece according to the invention includes a gasket seal 16 which is advantageously formed by a seal with a full lip extending, as is clearly seen on the attached figure, over the entire frontal surface SF of the cell P.

Such lip seal 16 which includes no discontinuity from its most exterior peripheral edge towards the center is constituted by an elastomeric material such as nitrile, or vulcanized rubber.

The cell cap 14 includes an intermediate stopper 18 likewise formed of an organic material such as a thermoplastic, for example polyoxymethylene referenced under the abbreviation POM and sold under the trademark "Delrin".

The stopper 18 is distinct from the cap 14 and set into the latter.

Such intermediate stopper 18 is freely housed in cap 14 with radial play and it is in direct bearing on a peripheral lip 20 formed on the gasket seal 16. The cell cap 14 which is formed by a swaged thin metallic sheet includes in its central portion an actuating notch 22 in which can be inserted a tool such as a coin in order to assure rotation of cap 14 and thus its opening and its closing. It will here be noted that cap 14 turns alone independently of stopper 1 8 which remains fixed in contact with seal 16.

To this effect, the timepiece according to the invention includes latching means 24 constituted by a bayonet system of known conception. Such system is constituted by several radial tongues 26 (a single one here being shown) extending radially from the peripheral edge 28 of cap 14 towards the exterior and engaging in a circular groove 30 which is formed in case 2 and which opens out radially into the entrance portion 12 of housing 6.

Thus, it is noted that the entrance portion 12 of housing 6 which is the stepped portion of such housing exhibiting the greatest diameter basically receives cap 14 and its stopper 18 as well as the latching means 24 described hereinbefore.

As seen in FIG. 1, lip 20 of the gasket seal 16 rests on a tapered bearing surface 32 formed in case 2 between the entrance portion 12 of housing 6 and the intermediate portion 10 of the latter. The tapered bearing surface 32 opens out towards the entrance of housing 6 with a slope of about 45° angle. Lip 20 is thus confined between such first tapered bearing surface 32 and a second tapered bearing surface 34 of substantially the same angle as the first, in this case formed on stopper 18 at the periphery of the latter. It is noted in other respects that lip 20 extends beyond the two tapered bearing surfaces respectively 32 and 34 which maintain it and that it projects towards the exterior in the entrance portion 12 of housing 6, in the vicinity of the peripheral edge 28 of cap 14. It will also be noted that the projecting portion of lip 20 forming the most extreme outer portion of the gasket seal 16 shows two faces at 90°, respectively 36 and 38 reinforcing the sealing function of the lip when it is subjected to high pressure. It is seen thus that during immersion of the timepiece in a liquid, such latter can come to penetrate into the entrance portion 12 of housing 6 to come into contact with faces 38 and 36 of the outer peripheral edge of lip 20.

Seal 16 includes furthermore a circular cheek 40 having the form of a rib which extends axially towards cell P and which is intended to come to rest in axial bearing on a bottom of the latter. The stopper 18 includes to this effect an interior corner 42 formed in the vicinity of the tapered bearing portion 34 and compressing the seal 16 in line with the cheek 40 in order to assure axial bearing of the cell P onto its electrical contacts, not shown.

It is thus understood that in addition to assuring sealing of the housing 6 the lip seal 16 of the timepiece according to the invention assures the axial bearing of the cell P towards the bottom of housing 6 and in particular towards its bottom portion 8.

Seal 16 additionally includes a central bellows 44 which extends entirely under cell 6 at the interior of the circular cheek 40, such bellows exhibiting two characteristic bulging regions, one central and the other exterior coaxial to the first.

The gasket seal 16 is radially maintained in case 2 and more specifically in the intermediate portion 10 of housing 6 by means of an intermediate cylindrical bearing surface 48 formed at the entrance of the portion of housing 8 receiving the cell. A corresponding cylindrical bearing surface 50 is formed on the periphery of the seal 16 in a manner adjacent and contiguous to lip 20, such bearing surface 50 being housed within the cylindrical bearing surface 48 of housing 6 in order to assure adjustment and radial positioning of seal 16 in case 2.

One also notes that the cylindrical bearing surface 48 formed in case 2 includes a reentrant edge 52 in which is engaged a corresponding .tapered edge 54 formed on the lip seal 16 in a manner to be opposite lip 20.

What I claim is:

1. A timepiece comprising:

a watch case;

a power cell compartment formed by a housing arranged in the interior of said case so as to receive through an entrance of the housing an electrical energy source formed by a power cell; and closing means for the entrance of the housing comprising movable cap means capable of being mechanically latched onto the case and a gasket seal shaped to be interposed between the cap means and said case, said gasket seal extending over the entire frontal surface of the power cell and assuring, in addition to the sealing of the housing, an axial bearing of the power cell towards the bottom of the housing, said gasket seal comprising a lip formed on the periphery of the seal and a cylindrical bearing surface adjacent to the lip, said lip being squeezed between a first and a second tapered bearing surface provided respectively on the case and on said cap means, and said cylindrical bearing surface of the seal being engaged in a corresponding cylindrical bearing surface formed on the case adjacent to the entrance of the housing to radially position the seal and maintain said lip in fixed relation with respect to said first tapered bearing surface.

2. A timepiece as set forth in claim 1, wherein said cap means includes an intermediate plastic stopper which is freely housed therein and which bears directly on said peripheral lip of the gasket seal.

3. A timepiece as set forth in claim 2, wherein said first tapered bearing surface on the case opens outwardly towards the entrance of said housing, and said second tapered bearing surface is formed on the periphery of said stopper.

4. A timepiece as set forth in claim 1, wherein said lip extends beyond the two tapered bearing surfaces which squeeze it and projects towards the exterior of said case in the vicinity of a peripheral edge of said cap means.

5. A timepiece as set forth in claim 2, wherein said seal includes a circular cheek in the form of a rib extending towards the power cell and bearing axially on the bottom of the latter, and wherein the stopper includes an inner corner compressing said seal in the line of said cheek.

6. A timepiece as set forth in claim 5, wherein said seal includes a central bellows extending under the power cell interiorly of the circular cheek.

7. A timepiece as set forth in claim 1, wherein said cylindrical bearing surface formed on the case includes a reentrant edge into which fits a correspondingly tapered edge of said seal arranged opposite to said lip.

* * * * *